US005261327A

United States Patent [19]

Carney

[11] Patent Number: 5,261,327

[45] Date of Patent: Nov. 16, 1993

[54] BLASTING METHOD AND COMPOSITION

[76] Inventor: Patrick Carney, 1080 Nowata, Dubuque, Iowa 52001

[21] Appl. No.: 827,413

[22] Filed: Jan. 29, 1992

[51] Int. Cl.[5] ..... F42B 3/00; C06B 25/34

[52] U.S. Cl. ..... 102/312; 102/313; 149/92

[58] Field of Search ..... 102/312, 313; 149/92, 149/46; 299/13; 86/20.15

[56] References Cited

U.S. PATENT DOCUMENTS

| | | | |
|---|---|---|---|
| 4,012,246 | 3/1977 | Forrest | 149/47 |
| 4,042,431 | 8/1977 | Friant et al. | 149/36 |
| 4,132,574 | 1/1979 | Forrest | 149/2 |
| 4,161,142 | 7/1979 | Edwards et al. | 102/313 X |
| 4,490,196 | 12/1984 | Funk | 149/92 |
| 4,555,279 | 11/1985 | Funk | 149/92 |
| 4,614,146 | 9/1986 | Ross et al. | 102/313 X |
| 4,936,933 | 6/1990 | Yabsley et al. | 102/313 X |
| 5,071,496 | 12/1991 | Coursen et al. | 102/313 X |

*Primary Examiner*—Peter A. Nelson

*Attorney, Agent, or Firm*—Zarley, McKee, Thomte, Voorhees & Sease

[57] ABSTRACT

A method of quarry blasting is provided wherein boreholes are loaded with alternating layers of ANFO and AP propellant. A primary charge is used to detonate the composition column. The low velocity propellant enhances the ANFO explosion, and produces high pressure gas and high temperatures for breaking and casting the rock, while minimizing fly rock, ground vibrations, and air noise.

40 Claims, No Drawings

BLASTING METHOD AND COMPOSITION

BACKGROUND OF THE INVENTION

Quarry blasting for rock, such as limestone, granite, and other igneous rocks conventionally uses ANFO as the explosive. ANFO is a mixture of approximately 94% ammonium nitrate and 6% fuel oil.

In quarry blasting, a plurality of boreholes are drilled in a predetermined pattern or array. For example, the holes are drilled on a 10 foot×10 foot pattern, with 3–9 inch diameters and depths of 20–90 feet. A cast booster with a blasting cap is placed in the bottom of the hole, and ANFO is added into the hole up to level approximately eight feet from the surface. Small rock chips from ¼ inch–½ inch in size, commonly called stemming, is placed in the top of the hole to confine the ANFO. The boreholes are detonated sequentially so as to provide free faces toward which the broken rock moves.

The energy and powder factors vary, depending upon the geological structures being blasted. For example, limestone requires a power factor of 2–5 pounds per ton.

ANFO is also used in open pit mining, for such minerals as taconite, copper and gold. In open pit mines, the boreholes are typically 10–15 inches in diameter, drilled in a 28×28 foot pattern to produce 40–60 foot faces. Powder factors vary from 0.53–0.85 pounds per yard.

ANFO is a popular explosive in both quarry mining and open pit mining due to its low cost. However, ANFO has several limitations. When the boreholes are filled with solid columns of ANFO, only 60–70% efficiency is achieved as the detonation rises in the borehole. Accordingly, in such a straight ANFO shot, the 30–40% waste must be considered to avoid oversize material which is detrimental to the digging and crushing equipment used after the blast to process the shot rock. Also, such waste increases the cost of producing the shot rock.

Numerous methods have been developed to overcome the inefficiencies of a solid ANFO shot and to enhance the action of ANFO in the borehole. The most common method is alternate velocity loading, wherein cartridges of dynamite or emulsion are alternatingly layered with ANFO in the column. The use of these high explosives contributes to a more complete reaction of the ANFO, due to higher pressures and temperatures near these booster cartridges. This alternate velocity loading produces better fragmentation of the rock, and allows for expanded borehole drill patterns, both of which decrease the cost of the shot rock produced. However, there are physical and environmental hazards associated with the use of alternative velocity loading.

Alternate velocity loading produces excessive fly rock, which is the wild uncontrolled throw of rock from the detonation. Fly rock results from overloading of the holes, lack of burden or confinement, and structural abnormalities in the rock being blasted. Fly rock is the number one killer in quarry operations.

Another problem of alternate velocity loading is excessive ground vibrations and air blast noise. Vibration and noise carry to areas surrounding the quarry site, and therefore, must be minimized to avoid damage to property.

Alternate velocity loading also increases the cost of the shot rock, due to the increased expense of the emulsion and/or dynamite.

Solid AP propellant has been manufactured for many years, but has not been used in blasting operations due to its expense. This propellent is a mixture of approximately 70% ammonium perchlorate, 20% aluminum and 10% binder. AP propellent is a low velocity, class B explosive, as compared to dynamite which is a high velocity, class A explosive. Solid propellants typically have been used as rocket fuel, such as in the Minuteman missiles. Nuclear disarmament treaties, such as SALT and START, require that such missiles be disarmed, including the destruction of the propellant. Much AP propellant manufactured for other uses has reached its designated shelf life, and also must be destroyed, along with scrap propellant from the manufacturing process. In the past, the propellant has been disposed of by open air firing of the propellant motors, or open burning of the propellant. However, these methods of disposal are no longer viable due to stringent Environmental Protection Agency pollution regulations.

Accordingly, a primary objective of the present invention is the provision of an improved blasting method and blasting composition.

Another objective of the present invention is the provision of a blasting method utilizing ANFO and solid AP propellant.

A further objective of the present invention is the provision of a blasting method having improved fragmentation of shot rock, and decreased fly rock, ground vibration and noise.

Still a further objective of the present invention is the provision of an improved blasting operation which relies upon heat and gas pressure, as opposed to detonation velocity for producing high quality shot rock.

Yet another objective of the present invention is a blasting composition which utilizes solid propellant to enhance the effect of ANFO.

Another objective of the present invention is the utilization of a solid propellant waste material having environmental liabilities as a useful blasting product and procedure.

A further objective of the present invention is the provision of a blasting method and composition which is safe and economical to use.

These and other objectives will become apparent from the following description of the invention.

SUMMARY OF THE INVENTION

The new and improved blasting composition and method of quarry blasting of the present invention utilizes alternating layers of ANFO and solid AP propellant in a predetermined pattern of boreholes. A primary charge is placed in the bottom of each borehole and covered with a layer of ANFO. Solid AP propellant and ANFO are then alternatingly placed in the borehole. Stemming material is used to cover the last layer of ANFO and to fill the last several feet of the borehole. The boreholes are wired in series so as to be sequentially detonated. The use of AP propellant in conjunction with the ANFO enhances the detonation of the ANFO, and produces increased gas pressures and temperatures to produce a well-fragmentized rock product with minimal fly rock, noise and vibration.

DESCRIPTION OF THE PREFERRED EMBODIMENT

A solid 1.3 AP propellant from rocket motors or other sources is cut or crushed to a suitable size. This is an ammonium perchlorate based Class B, low explosive which yields a high gas pressure upon detonation. The AP propellant is mixed, in alternating layers, with ANFO, which is a mixture containing approximately 94% ammonium nitrate and 6% diesel fuel. This mixture of AP propellant and ANFO is preferably in a ratio of 40% propellant and 60% ANFO. Upon detonation of this explosive composition in a borehole, high gas pressure and temperatures are produced, without compression stress wave fronts. The explosion of the composition yields minimal fly rock, ground vibrations, and air noise, while producing a well-fragmented shot rock.

In using this new explosive composition at a quarry or open pit mine, a plurality of boreholes having predetermined diameters and depths are drilled in a predetermined pattern or array. A primary charge, such as a cast booster, is lowered into the bottom of the hole. Wire leads from the primary charge extend upwardly to the top of the hole and are secured to prevent the wires from falling into the hole.

ANFO is poured into the hole to cover the primary charge to a depth of approximately 12 inches. AP propellant, in either stick or crushed form, is then placed in the hole. An additional 6–8 inches of ANFO is then added on top of the propellant. In the case of stick propellant, the ANFO fills any space between the propellant and the borehole wall. This layering of ANFO and propellant is repeated until the borehole is filled to approximately 10 feet from the surface. An additional 3 feet, approximately, of ANFO is added to the hole. An additional primary charge may be inserted in the hole on top of the ANFO and propellant column. The remaining portion of the hole is filled with stemming to confine the charge.

The boreholes are wired in series. After the normal and appropriate safety precautions are taken, the blast is initiated by actuating the primary charge or charges. The AP propellant enhances the detonation of the ANFO. The resulting explosion yields high gas pressures and temperatures. The low velocity, high gas pressures, and high temperatures produces well-fragmented rock product, with minimal fly rock, minimal vibration and minimal noise. Virtually no waste stream is produced, since the propellant is completely consumed in the explosion.

The ANFO/propellant composition allows the use of less boreholes, and accordingly, less explosive agents, to produce the same amount of rock, thereby saving on costs while minimizing hazards such as fly rock, noise and vibration. Furthermore, the cost of AP propellant from rocket motors and scrap is significantly less than the cost of dynamite and emulsions normally used in alternative velocity loading, thereby further reducing the cost of producing the rock.

The use of AP propellant as an explosive product also avoids EPA regulations regarding open burning and other methods of destroying the propellant.

Thus, from the foregoing, it can be seen that all of the stated objectives are accomplished by the present invention.

What is claimed is:

1. A method of quarry blasting, comprising: drilling a predetermined number of boreholes; placing a primary charge in the bottom of each borehole with wire leads extending to the top o each borehole; alternatingly layering a quantity of ANFO and a quantity of solid propellant into each borehole until the borehole is substantially full; adding stemming material to completely fill each borehole; wiring the boreholes in series; and actuating the blast.

2. The method of claim 1 wherein propellant is covered near the top of the borehole with ANFO.

3. The method of claim 1 wherein the propellant is a low velocity propellant.

4. The method of claim 1 wherein the propellant is a 1.3 propellant.

5. The method of claim 1 wherein the propellant is an ammonium perchlorate (AP) propellant.

6. The method of claim 1 wherein the primary charge is a cast booster.

7. The method of claim 1 further comprising placing a second primary charge into the hole after the last layer of ANFO and before the stemming material.

8. A blasting composition, comprising:

a quantity of ANFO, and a quantity of AP propellant.

9. The blasting composition of claim 8 wherein the ANFO is alternatingly layered with the propellant.

10. The blasting compound of claim 8 wherein the ratio of ANFO to propellant is 60:40.

11. The blasting compound of claim 8 wherein the propellant is a low velocity propellant.

12. The blasting compound of claim 8 wherein the propellant is 1.3 propellant.

13. The blasting compound of claim 8 wherein the propellant is an ammonium perchlorate propellant.

14. A blasting method comprising:

selectively placing respective ANFO and solid propellant compositions in a non-random manner in a borehole providing a primary charge in the borehole; detonating the primary charge, and thereby the ANFO and propellant.

15. The method of claim 14 wherein the propellant is a low velocity propellant.

16. The method of claim 14 wherein the propellant is a 1.3 propellant.

17. The method of claim 14 wherein the propellant is an ammonium perchlorate propellant.

18. The method of claim 14 wherein the ANFO and propellant are alternatingly layered in the borehole.

19. The method of claim 14 wherein the ANFO and propellant are placed in the borehole as a mixture.

20. The method of claim 14 wherein the ANFO and propellant comprises a 60:40 ratio.

21. The blasting composition of claim 8 wherein the ANFO and propellant are a mixture.

22. An improved method of alternate velocity loading of ANFO, the improvement comprising:

using a 1.3 propellant for the alternate velocity loading of ANFO whereby the detonation of the ANFO is enhanced and results in increased gas pressure and temperature to produce well fragmented product with minimal noise, vibration and flyrock.

23. An improved method as in claim 22 wherein the propellent is an ammonium perchlorate propellant.

24. An improved method as in claim 23 wherein the ammonium perchlorate propellant is in a cut form.

25. An improved method as in claim 23 wherein the ammonium perchlorate propellant is in a crushed form.

26. An improved method as in claim 25 wherein the crushed ammonium perchlorate propellant is mixed, in alternating layers, with the ANFO so as to form a mixture therewith.

27. An improved method as in claim 25 wherein the crushed ammonium perchlorate propellant are alternately layered in the borehole.

28. The blasting compound of claim 13 wherein the ammonium perchlorate propellant is in a cut form.

29. The blasting agent of claim 13 wherein the ammonium perchlorate propellant is in a crushed form.

30. The blasting agent of claim 29 wherein the crushed ammonium perchlorate propellant is mixed, in alternating layers, with the ANFO so as to form a mixture therewith.

31. The blating compound of claim 8 further comprising an emulsion for use in wet boreholes.

32. A method of blasting comprising:

providing a predetermined number of boreholes;

placing at least one primary charge in each of said boreholes;

placing explosive agents in said boreholes to create an explosive column along a predetermined length of said borehole, said explosive agents comprised of a first agent comprising ANFO and a second agent which is a solid explosive that does not detonate; and actuating said primary charge to initiate the blast.

33. A method as in claim 32 where the second agent is solid propellant.

34. A method as in claim 33 wherein the solid propellant is an ammonium perchlorate propellant.

35. A method as in claim 33 wherein the propellant is in a cut form.

36. A method as in claim 33 wherein the solid propellant is in a crushed form.

37. A method as in claim 32 wherein the solid propellant is in crushed form and placed at various predetermined locations in the charge column.

38. A method as in claim 39 wherein said predetermined locations are numerous whereby the crushed propellant is interspersed within the ANFO so as to form a mixture therewith.

39. A method as in claim 32 wherein the solid propellant is in a cut form and placed at various predetermined positions in the charge column.

40. A method as in claim 34 wherein the placement of said propellant is such that ANFO fills the space between the propellant and the borehole wall.

* * * * *